US006331755B1

(12) United States Patent
Ribarich et al.

(10) Patent No.: US 6,331,755 B1
(45) Date of Patent: Dec. 18, 2001

(54) CIRCUIT FOR DETECTING NEAR OR BELOW RESONANCE OPERATION OF A FLUORESCENT LAMP DRIVEN BY HALF-BRIDGE CIRCUIT

(75) Inventors: Thomas J. Ribarich, Laguna Beach; Talbott M. Houk, Culver City, both of CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 09/095,062

(22) Filed: Jun. 10, 1998

Related U.S. Application Data

(60) Provisional application No. 60/071,482, filed on Jan. 13, 1998.

(51) Int. Cl.[7] ..... H05B 37/02

(52) U.S. Cl. ..... 315/225; 315/119; 315/307

(58) Field of Search ..... 315/224, 225, 315/291, 294, 295, 300, 307, 209 R, DIG. 4, 119

(56) References Cited

U.S. PATENT DOCUMENTS

| | | | | |
|---|---|---|---|---|
| 5,049,790 | | 9/1991 | Herfurth et al. | 315/291 |
| 5,420,779 | * | 5/1995 | Payne | 363/56 |
| 5,550,433 | * | 8/1996 | Tobler | 315/94 |
| 5,699,238 | | 12/1997 | Lee et al. | 363/21 |
| 5,705,894 | * | 1/1998 | Krummel | 315/119 |
| 5,808,455 | * | 9/1998 | Schwartz et al. | 323/271 |
| 5,883,473 | * | 3/1999 | Li et al. | 315/225 |
| 5,969,483 | * | 10/1999 | Li et al. | 315/225 |

FOREIGN PATENT DOCUMENTS

| | | |
|---|---|---|
| 0399613 | 11/1990 | (EP) . |
| WO9325952 | 12/1993 | (WO) . |
| WO9743878 | 11/1997 | (WO) . |
| WO9846053 | 10/1998 | (WO) . |

* cited by examiner

*Primary Examiner*—Don Wong
*Assistant Examiner*—Ephrem Alemu
(74) *Attorney, Agent, or Firm*—Ostrolenk, Faber, Gerb & Soffen, LLP

(57) ABSTRACT

A circuit which detects near or below resonance operation of a fluorescent lamp being driven with a half-bridge circuit and which deactivates the half-bridge circuit before any damage to the circuit can result. In the circuit of the present invention, the voltage across a sense resistor disposed either the lower transistor switch and ground, or between the lower lamp filament and ground, is compared against a predetermined reference voltage to generate an output comparison signal. The output comparison signal is gated to the turn-off edge of the lower MOSFET (in the case of the sense resistor disposed between the lower MOSFET and ground) or to the turn-off edge of the upper MOSFET (in the case of the sense resistor between the lower lamp filament and ground) to generate a signal for shutting down the half-bridge circuit in the event of near or below resonance operation of the lamp resonant circuit.

9 Claims, 4 Drawing Sheets

CIRCUIT FOR DETECTING NEAR OR BELOW RESONANCE OPERATION OF A FLUORESCENT LAMP DRIVEN BY HALF-BRIDGE CIRCUIT

The present invention claims the benefit of U.S. provisional application Ser. No. 60/071,482, filed on Jan. 13, 1998.

BACKGROUND OF THE INVENTION

1. Field of the Invention

The present invention relates to a fluorescent lamp with a resonant type circuit driven by a half-bridge circuit and, more particularly, to a circuit for detecting near or below resonance operation of such a lamp.

2. Description of the Related Art

FIG. 1 shows a typical lamp resonant output stage being driven by a half-bridge circuit including MOSFETS M1 and M2 providing current $I_{L1}$ through inductor L1 to the lamp connected in parallel with capacitor C1. A sense resistor $R_{CS}$ is connected between the source of lower MOSFET M2 and ground. As shown in the timing diagram of FIG. 2, under normal operating conditions, the phase of the inductor current $I_{L1}$ with respect to the half-bridge voltage $V_S$ lies somewhere between 0 and −90 degrees. Should the phase approach 0 degrees, however, the frequency is approaching resonance. At or near resonance, non-zero voltage switching can occur at the half-bridge, resulting in a large current spike at turn-on in either of the two half-bridge switches, as shown in the timing diagram of FIG. 3.

Referring to the transfer function for running and before ignition conditions depicted in FIG. 4, it is also possible for the resonant lamp output stage to be operating above the resonance frequency of the low-Q circuit (during running), but below the resonance frequency of the high-Q (before ignition) circuit. If the lamp is then removed, the transfer function jumps from the low-Q to the high-Q curve while the frequency remains unchanged and below the resonance frequency of the high-Q circuit. This results in almost immediate destruction of the half-bridge.

Another condition which can cause below resonance operation is if the filaments of the lamp are intact, but the gas within the lamp escapes (e.g., the glass cracks). In this condition, the load operating condition would instantaneously change from the damped (above resonance) to the undamped (below resonance).

Accordingly, it would be desirable to be able to detect of operation of the lamp near or below the resonance frequency, and to shutdown operation of the lamp under such conditions to prevent catastrophic failure of the switching devices (usually MOSFETs) of the half-bridge driver circuit.

SUMMARY OF THE INVENTION

The present invention is a circuit which detects near or below resonance operation of a fluorescent lamp being driven with a half-bridge circuit and which deactivates the half-bridge circuit before any damage to the circuit can result.

More specifically, in the circuit of the present invention, the voltage across a sense resistor disposed either the lower transistor switch and ground, or between the lower lamp filament and ground, is compared against a predetermined reference voltage to generate an output comparison signal. The output comparison signal is gated to the turn-off edge of the lower MOSFET (in the case of the sense resistor disposed between the lower MOSFET and ground) or to the turn-off edge of the upper MOSFET (in the case of the sense resistor between the lower lamp filament and ground) to generate a signal for shutting down the half-bridge circuit in the event of near or below resonance operation of the lamp resonant circuit.

The circuit of the present invention is advantageously applicable to any resonant circuit, such as a resonant-mode power supply.

Other features and advantages of the present invention will become apparent from the following description of the invention which refers to the accompanying drawings.

DETAILED DESCRIPTION OF THE PREFERRED EMBODIMENT

Figure 1:
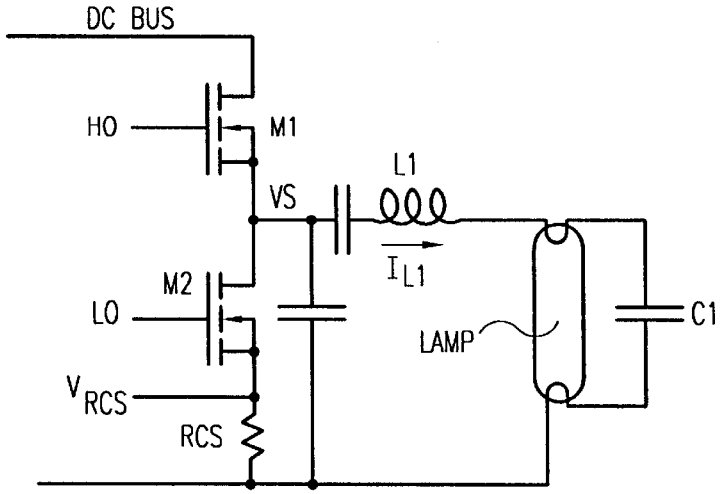
FIG.1 PRIOR ART
FIG. 1 shows a typical lamp resonant output stage being driven by a half-bridge.
Figure 2:
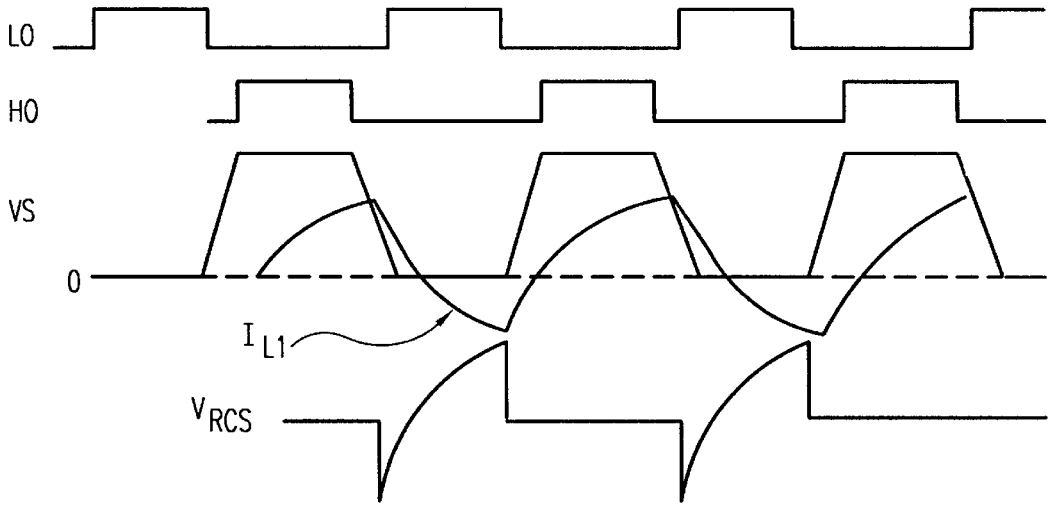
FIG.2 PRIOR ART
FIG. 2 is a timing diagram showing the current and voltage waveforms of the lamp resonant circuit during normal operating conditions.
Figure 3:
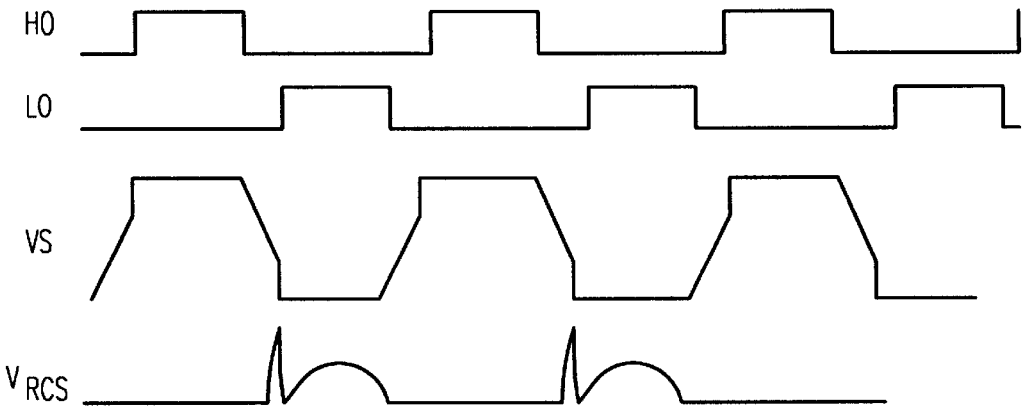
FIG.3 PRIOR ART
FIG. 3 is a timing diagram showing the current and voltage waveforms of the lamp resonant circuit during near resonance operation.
Figure 4:
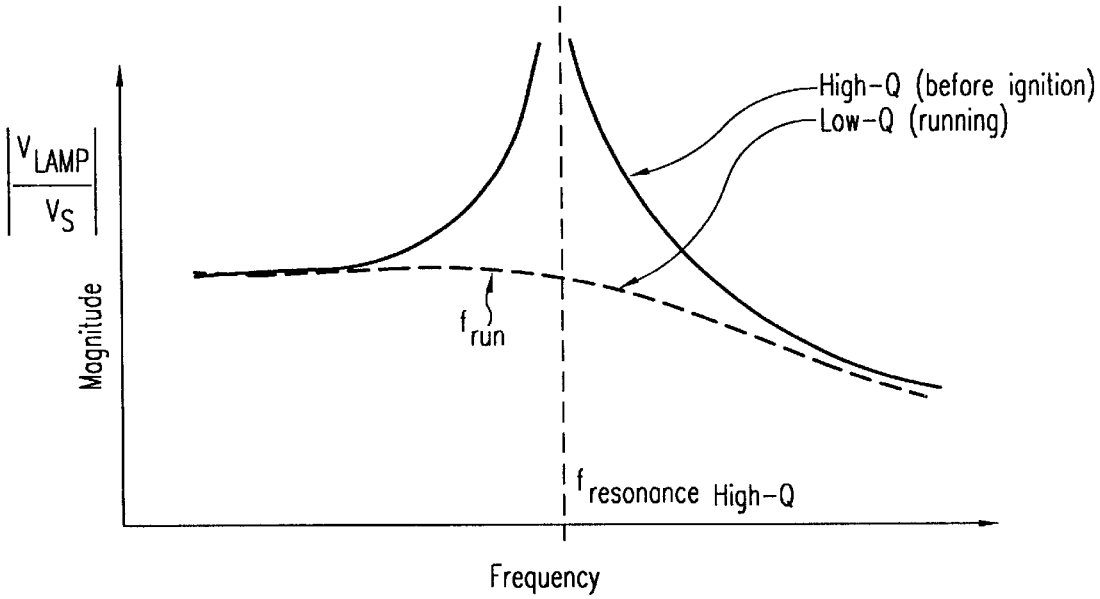
FIG.4 PRIOR ART
FIG. 4 shows the transfer function of the lamp resonant circuit for running and below resonance conditions.
Figure 5:
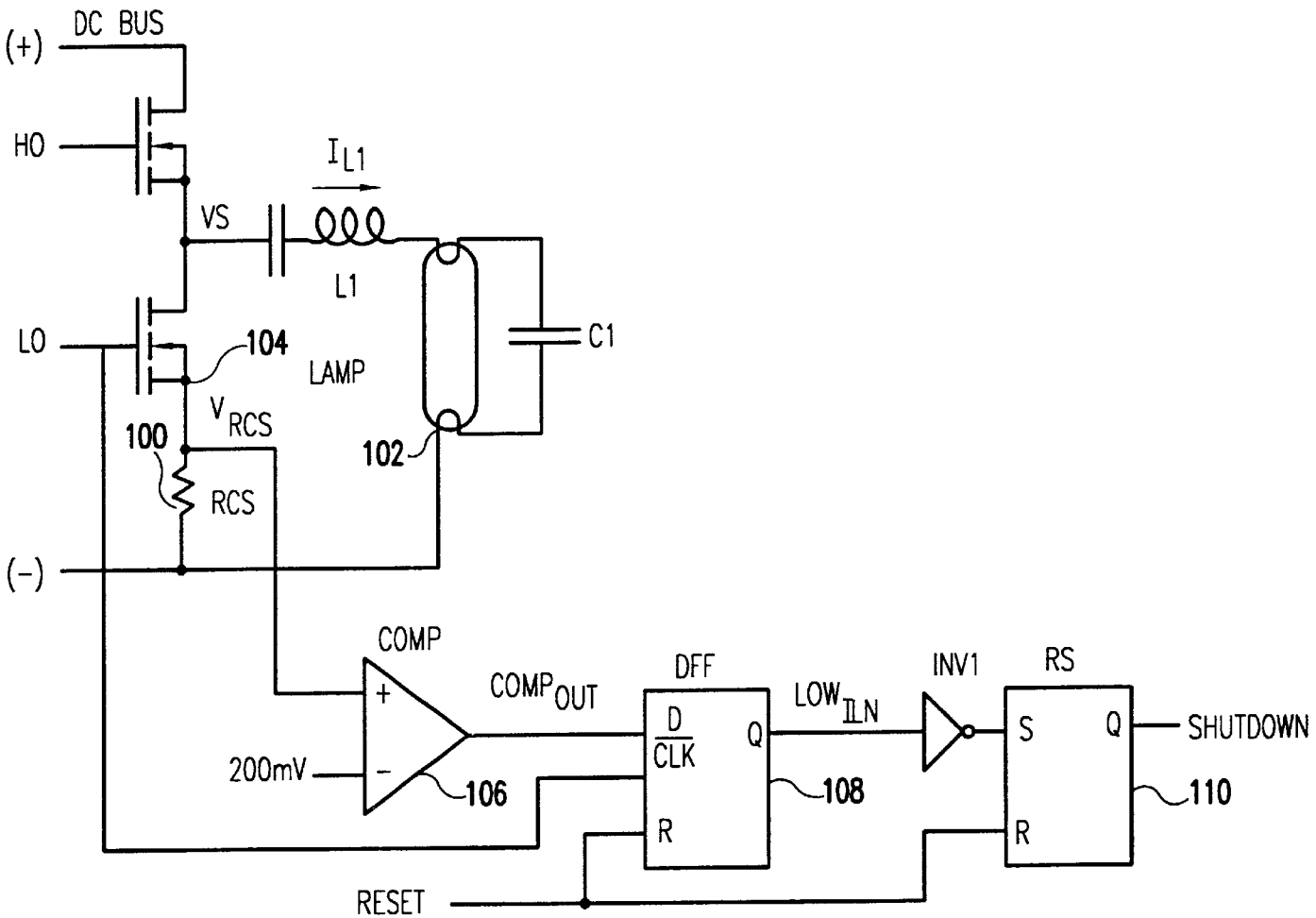
FIG. 5 is a circuit schematic of the near or below resonance detection circuit of the present invention.

Referring to FIG. 5, the circuit of the present invention is configured to detect near or below resonance operation of a fluorescent lamp. The circuit of the present invention senses the inductor current and compares it against a predetermined low-voltage threshold which is high enough in a dimming lamp so as not to interfere with the proper operation of the lamp, but not so high that it signals a fault condition unnecessarily far above the resonant freqency.

More specifically, in the circuit of the present invention, the inductor current is sensed with a resistor 100 disposed between the lower lamp filament 102 and ground (shown in dashed lines), or, as shown in FIG. 5, between the source of the lower half-bridge MOSFET 104 of the driver circuit and ground. The sensed voltage is compared against a reference voltage (e.g. 200 mV as shown in FIG. 5) by a comparator 106, and the output of comparator 106 is then gated to the turn-off edge of the gate signal for the appropriate MOSFET (LO when sensing current at the source of the lower MOSFET 104, HO when sensing at lower lamp filament 102). In the preferred embodiment of the invention shown in FIG. 5, this gating is accomplished using a D-type Flip Flop 108.

Figure 6:
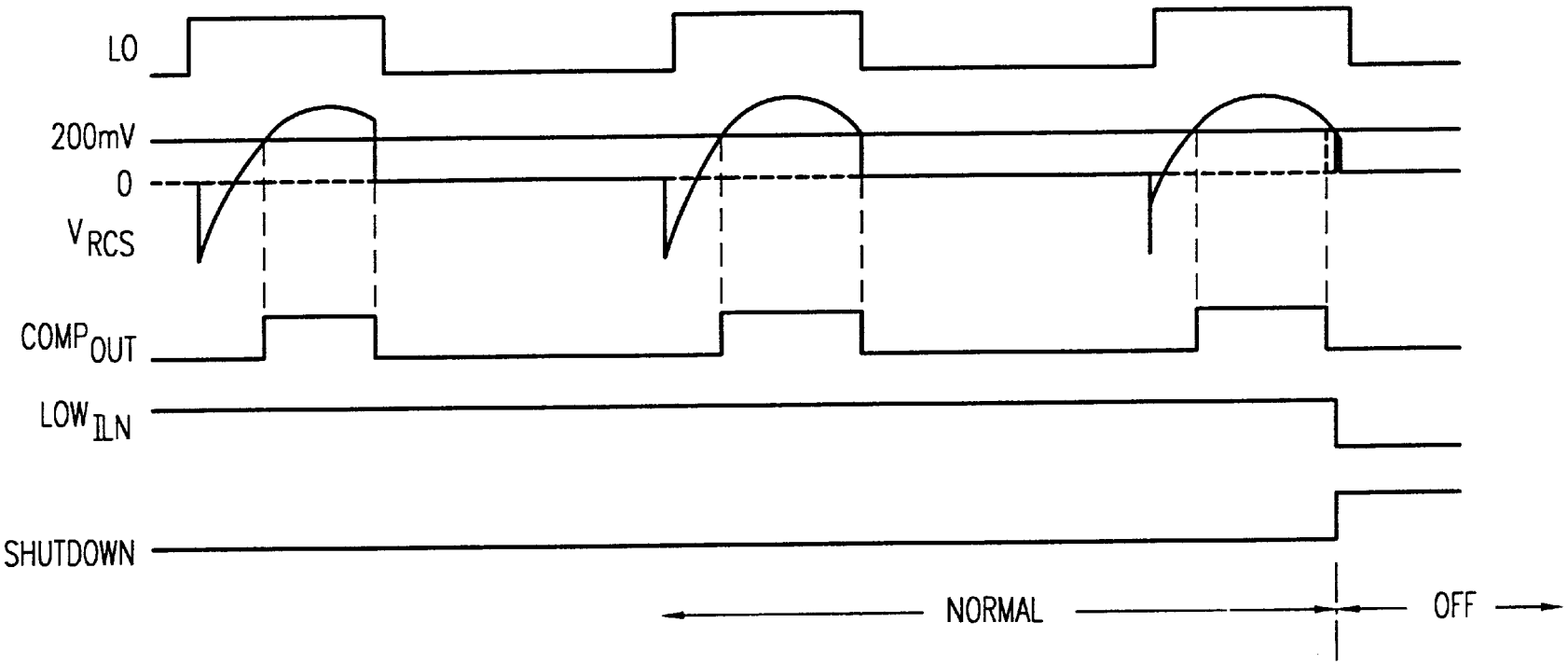
FIG. 6 shows the timing diagram for the near or below resonance detection circuit of the present invention.

With reference to the timing diagram of FIG. 6, if the voltage across sense resistor 100 falls below the lower-voltage threshold (200 mV) at the turn-off of the appropriate MOSFET, indicative of the phase angle of the inductor (L1) current with respect to the half-bridge voltage approaching zero and therefore the operating frequency near or below the resonance frequency of the output stage, the Q-output of D-type Flip Flop 108 goes low, driving the output of RS Flip Flop 110 high, and the half-bridge circuit is latched off.

The near or below resonance operation detection is performed by the circuit of the present invention on a cycle-by-cycle basis, so shutdown occurs almost immediately. This is important for load removal, when the transfer function changes abruptly from above resonance to below resonance and the half-bridge should be shut down within the next cycle of fault occurrence.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circuit for detecting near or below resonance operation of a lamp resonant circuit, said lamp resonant circuit including an inductor having a current passing therethrough, the current in said lamp resonant circuit being driven by an alternating voltage produced at a node between upper and lower transistor switches disposed in a half-bridge configuration, said circuit comprising:

a sense resistor disposed between the lower transistor switch and ground;

means for comparing the voltage across said sense resistor against a predetermined reference voltage to generate an output comparison signal; and means for gating the output comparison signal to the turn-off edge of the lower MOSFET to generate a signal indicative of a situation in which the inductor current and the voltage at the node between the upper and lower switches of the half-bridge circuit have a phase angle therebetween approaching zero, thereby signifying near or below resonance operation of the lamp resonant circuit, and shutting down the half-bridge circuit in response to the signal.

2. A circuit as recited in claim 1, wherein said means for gating the output comparison signal to the turn-off edge of the lower MOSFET comprises a D-type Flip Flop.

3. A circuit for detecting near or below resonance operation of a lamp resonant circuit including a lamp having upper and lower lamp filaments circuit, said lamp resonant circuit including an inductor having a current passing therethrough, the current in said lamp resonant circuit being driven by an alternating voltage produced at a node between upper and lower transistor switches disposed in a half-bridge configuration, said circuit comprising:

a sense resistor disposed between the lower lamp filament and ground;

means for comparing the voltage across said sense resistor against a predetermined reference voltage to generate an output comparison signal; and means for gating the output comparison signal to the turn-off edge of the upper MOSFET to generate a signal indicative of a situation in which the inductor current and the voltage at the node between the upper and lower switches of the half-bridge circuit have a phase angle therebetween approaching zero, thereby signifying near or below resonance operation of the lamp resonant circuit, and shutting down the half-bridge circuit in response to the signal.

4. A circuit as recited in claim 3, wherein said means for gating the output comparison signal to the turn-off edge of the lower MOSFET comprises a D-type Flip Flop.

5. A method for detecting near or below resonance operation of a lamp resonant circuit driven by upper and lower transistor switches disposed in a half-bridge configuration, said lamp resonant circuit including an inductor having a current passing therethrough, the current in said lamp resonant circuit being driven by an alternating voltage at a node disposed between the upper and lower transistor switches of the half-bridge, said method comprising the steps of:

sensing the voltage across a sense resistor disposed between the lower transistor switch and ground;

comparing the voltage across said sense resistor against a predetermined reference voltage to generate an output comparison signal; and gating the output comparison signal to the turn-off edge of the lower MOSFET to generate a signal indicative of a situation in which the inductor current and the voltage at the node between the upper and lower switches of the half-bridge circuit have a phase angle therebetween approaching zero, thereby signifying near or below resonance operation of the lamp resonant circuit, and shutting down the half-bridge circuit in response to the signal.

6. A method as recited in claim 5, wherein said detection of near or below resonance operation is performed on a cycle-by-cycle basis.

7. A method for detecting near or below resonance operation of a lamp resonant circuit-including an inductor having a current passing therethrough for driving a lamp having upper and lower lamp filaments, the current in said lamp resonant circuit being driven by an alternating voltage at a node disposed between upper and lower transistor switches disposed in a half-bridge configuration, said method comprising the steps of:

sensing the voltage across a sense resistor disposed between the lower lamp filament and ground;

comparing the voltage across said sense resistor against a predetermined reference voltage to generate an output comparison signal; and gating the output comparison signal to the turn-off edge of the upper MOSFET to generate a signal indicative of a situation in which the inductor current and the voltage at the node between the upper and lower switches of the half-bridge circuit have a phase angle therebetween approaching zero, thereby signifying near or below resonance operation of the lamp resonant circuit, and shutting down the half-bridge circuit in response to the signal.

8. A method as recited in claim 7, wherein said detection of near or below resonance operation is performed on a cycle-by-cycle basis.

9. A circuit for detecting near or below resonance operation of a resonant load circuit, said resonant load circuit having a path through which a load current flows, said load current being driven by an alternating voltage generated by a switching transistor, the circuit comprising:

a sense resistor disposed in the path of the load current;

means for comparing the voltage across said sense resistor against a predetermined reference voltage to generate an output comparison signal;

means for gating the output comparison signal to the turn-off edge of the switching transistor to generate a signal indicative of a situation in which the load current and the alternating voltage generated by the switching transistor have a phase angle therebetween approaching zero, thereby signifying near or below resonance operation of the resonant load circuit; and means for generating a signal to turn-off the switching transistor and terminate the load current in accordance with the output comparison signal in the event of near or below resonance operation of the resonant load circuit.

* * * * *